US005729846A

United States Patent [19]

Sullivan

[11] Patent Number: 5,729,846

[45] Date of Patent: Mar. 24, 1998

[54] BEACH TOWEL WITH POCKET FOR PILLOW

[76] Inventor: William Sullivan, Calle Tamanique #17, San Tecla, El Salvador

[21] Appl. No.: 782,594

[22] Filed: Jan. 13, 1997

[51] Int. Cl.[6] ..... A47G 9/00

[52] U.S. Cl. ..... 5/419; 5/923

[58] Field of Search ..... 5/417–420, 490, 5/923, 922

[56] References Cited

U.S. PATENT DOCUMENTS

| | | | |
|---|---|---|---|
| 2,898,609 | 8/1959 | Store | 5/419 |
| 4,316,287 | 2/1982 | Rule | 5/419 |
| 4,634,618 | 1/1987 | Greer et al. | 5/417 |
| 5,072,467 | 12/1991 | Hunt | 5/417 |
| 5,438,719 | 8/1995 | Anthony | 5/490 |
| 5,566,410 | 10/1996 | Schaechter | 5/490 |

FOREIGN PATENT DOCUMENTS

| | | | |
|---|---|---|---|
| 398584 | 9/1933 | United Kingdom | 5/419 |

*Primary Examiner*—Alexander Grosz

*Attorney, Agent, or Firm*—Malin, Haley, DiMaggio & Crosby, P.A.

[57] ABSTRACT

A combination beach towel and pillow case comprising a towel, which can be made of fiber-reactive dyed velour on one side for a decorative pattern, and a rectangular panel sized in shape and connected at two edges to form a pillow receiving compartment. The panel is folded over itself, connected at two edges and attached to one end of the beach towel, and can occupy approximately one-twelfth the surface area of the beach towel. Alternately, two rectangular panels can be attached at three edges and connected to one end of the beach towel to form the pillow compartment. The pillow compartment includes a closure at the pillow receiving opening to capture the pillow and keep sand and dirt from entering the pillow compartment and reaching the pillow. The pillow can be easily removed from the pillow compartment providing for easy cleaning of the towel, and easy replacement of the pillow.

2 Claims, 3 Drawing Sheets

BEACH TOWEL WITH POCKET FOR PILLOW

BACKGROUND OF THE INVENTION

1. Field of the Invention

This invention relates to the combination of a beach towel and a pocket with a closure for a pillow, and specifically to an improved beach towel and pillow case combination that provides both a practical and decorative beach towel that, in one embodiment, can be made of fiber-reactive dyed velour of high quality that includes a strategically placed pocket including a closure that can be used to hold a pillow.

2. Description of the Prior Art

Lying on the beach comfortably requires some type of ground cover which is placed on the sand, such as a mat or large beach towel, to prevent the user from getting sand on the body. A towel also functions to dry off oneself after a swim. A beach towel or mat cannot provide support to the head and neck, and typically folded clothing, additional towels, or other articles are used as a pillow by the individual.

The need for the use of a pillow used in conjunction with beach towel or beach blanket has been recognized and disclosed in previous patents. For example, U.S. Pat. No. 2,898,609 issued to Storie, discloses a beach pack that includes a body portion that can be used as a beach blanket, and that includes a storage pocket that can hold a pillow when the body portion is unfolded.

The overall construction of this device tends to be ill-suited for mass production techniques and to retain a certain decorative, festive look or indicia on the beach towel itself.

U.S. Pat. No. 4,231,125 issued to Tittl, discloses a beach towel that includes an extra long upper portion of material that can be folded down over itself. The extra long portion can attach to itself thus forming a tube that can be used as a partial covering for a pillow. Because the tube remains open at each end, the pillow is only partially covered thus permitting sand to enter the open ends of the "pillow tube" allowing the pillow to get dirty and wet.

U.S. Pat. No. 4,097,944 issued to Yulish, discloses a beach mat that includes an integral pillow that is permanently sewn to the mat. A permanent pillow hampers cleaning efforts and prevents the user from the selection of larger or smaller pillows.

U.S. Pat. No. 4,980,935 issued to Kazanowski et al., discloses a beach towel with a removable pillow permanently attached to a carrying bag. Because the carrying bag is permanently attached to the pillow in this invention, a standard pillow cannot be used.

U.S. Pat. No. 4,980,935 issued to Case, discloses a towel having an inflatable pillow that fits into a slit formed in a flap member that includes a compartment that holds the pillow. The pillow used in this invention is deflated to fit through the slit into the pillow compartment. A noninflatable pillow will not fit through the slit, requiring the use of an inflatable pillow which may not be as comfortable as a pillow that uses some other stuffing material.

Applicant's invention overcomes these problems by providing an improved beach towel and pillow combination that is conventional in size, shape, and construction materials, and that can use any type pillow. Also, the beach towel and pillow combination can provide for a decorative, aesthetically pleasing pattern using fiber-reactive dyed velour. Another important advantage of the present invention is that the pillow can be easily removed from the pillow compartment to change pillows and to allow easy cleaning of both the pillow and beach towel. The present invention includes a suitable fastener, such as hook and loop fabric fasteners, for closing the pillow compartment, capturing the pillow, and keeping sand and dirt out of the pillow compartment.

Velour, as used in the description herein, refers to any of various fabrics with a pile or nap surface resembling velvet used in towels, and especially beach towels. In one embodiment, cotton velour is used and has been very acceptable on one side of the towel of the towel having a velour surface for providing dyeing of very decorative colors. Although cotton velour is the most desirable, other equivalent fabrics suitable for use as towels and decorative surfacing can be utilized.

SUMMARY OF THE INVENTION

A combination beach towel and pillow case comprising, in one embodiment, a rectangular cotton fiber-reactive dyed velour towel substantially 60 inches in length and 30 inches in width having a pillow compartment with a closure affixed to one end. The towel has a decorative pattern on one side provided by the fiber-reactive dye on the velour surface. The velour is essentially a plurality of cut cotton loops that are formed on one side of the towel which is the decorative side. The other side of the towel can be made of uncut loops.

The pillow compartment, in accordance with the invention, includes fabric which may be the same cotton fiber-reactive dyed velour material as the towel, having a decorative pattern on one side, but may be any other suitable material. The pillow compartment, in one embodiment, is rectangular and sized approximately 14 inches in length and 9 inches in width and can be made of a rectangular panel folded in half upon itself and stitched along two sides. It can alternately be made of a pair of rectangular panels, each having four sides or edges, three of which are stitched together. The compartment can be permanently attached by stitching to one end of the towel. The panels' sides that are not stitched form an opening that can be perpendicular to the towel's narrower end. The unstitched panel edges form opening to receive the pillow. The opening formed at the unstitched panel edges includes a suitable closure means such as hook and loop fasteners, snaps, buttons, or similar fasteners.

The pillow compartment is thus attached at one of the panel edges to the top edge of the towel. The remainder of the compartment can be unattached to the towel which permits flexibility in placement of the pillow that is received within the compartment.

In operation of the invention as a beach towel, the towel can be readily used (decorative side up) with the pillow compartment portion lying on, above, or under the towel, with a suitable pillow received within the pillow compartment. The ability to place the pillow housed within the pillow compartment, either under the towel, on top of the towel, or above the towel in an out of the way position, permits a comfortable custom adjustment of pillow location to the user.

The pillow compartment panel or panels (first and second) are affixed to the non-decorated, non-dyed surface of the towel on the bottom side of the towel that would be against and contact the beach surface. The top surface of the towel has the decorative ornamentation provided by the fiber-reactive dye on the velour surface.

The pillow which is held in the pillow compartment is easily removed at the compartment opening to permit cleaning of the towel and pillow. Replacement of the pillow is easily accomplished. The size of the towel and the size of the pillow compartment can be varied to provide a larger towel and to accommodate larger pillows.

Accordingly, it is an object of this invention to provide an improved combination beach towel and pillow receiving compartment that is comfortable and easily used.

It is another object of this invention to provide a beach towel and pillow case combination that is constructed of fiber-reactive dyed velour on one side of the towel.

But yet another object of this invention is to provide an improved combination beach towel and pillow case that, when in use, allows the user to lie on the towel and place the pillow in a plurality of positions.

And still another object of this invention is to provide an improved beach towel and pillow case combination that permits the pillow to be easily removed for cleaning purposes.

In accordance with these and other objects which will become apparent hereinafter, the instant invention will now be described with particular reference to the accompanying drawings.

DESCRIPTION OF THE PREFERRED EMBODIMENTS

Figure 1:
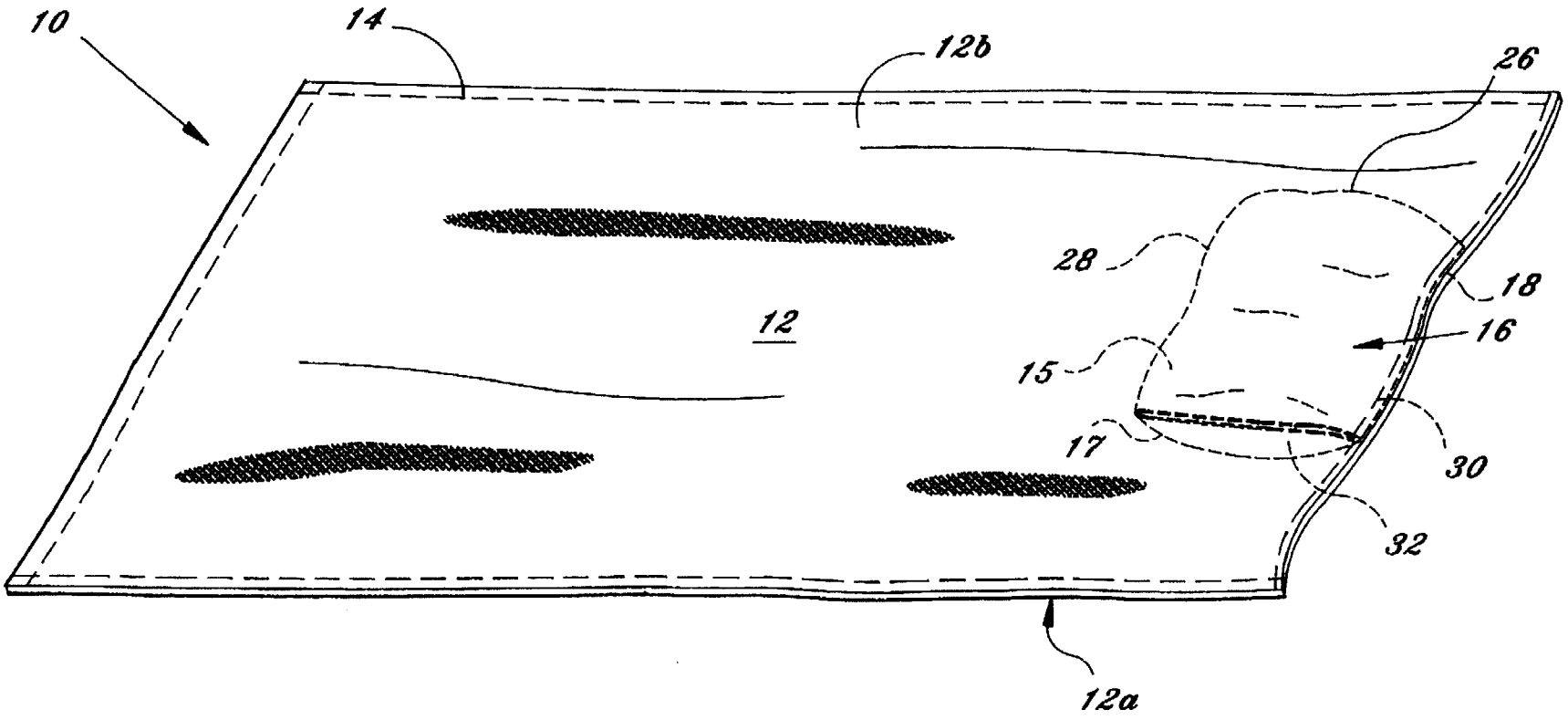
FIG. 1 shows a perspective view of the present invention with the pillow compartment in place under the towel portion.

Referring now to the drawings, and in particular FIG. 1, the present invention is shown generally at 10 and is comprised of a rectangular beach towel 12 constructed of any suitable material such as fiber-reactive dyed velour on one side **12*b* with side 12*a* comprising hooked cotton. Side 12*b*** with the reactive dyed velour can contain a decorative design or pattern that has been applied to the velour surface.

The pillow case compartment 16 can be made of the same material as the towel, or other suitable material, and can be sized as a rectangle whose length is approximately one-sixth of the total length of the towel and whose width is approximately one-half of the width of the towel (14 inches by 9 inches in one embodiment). Pillow compartment 16 can occupy approximately one-twelfth of the area of the towel 12. Pillow compartment 16 can alternately be made any suitable size. Towel 12 is typically sized as a beach towel and could be 60 inches long and 30 inches wide and can have stitching 14 at the perimeter.

The pillow compartment 16 can be made of two panels 15 and 17 blind stitched along edges 26 and 28, and stitched to towel 12 at end 18 by stitching 30. Pillow compartment 16 can be, and is preferably, constructed from a single panel integrally formed at edge 28, blind stitched at edge 26, and stitched to towel 12 at end 18 by stitching 30. Pillow compartment 16 may alternately be constructed in any other suitable manner. Pillow compartment 16 can be stitched to towel 12 on either side **12*a* or 12*b*, and is shown in FIGS. 1–3 stitched to side 12*a***.

Figure 2:
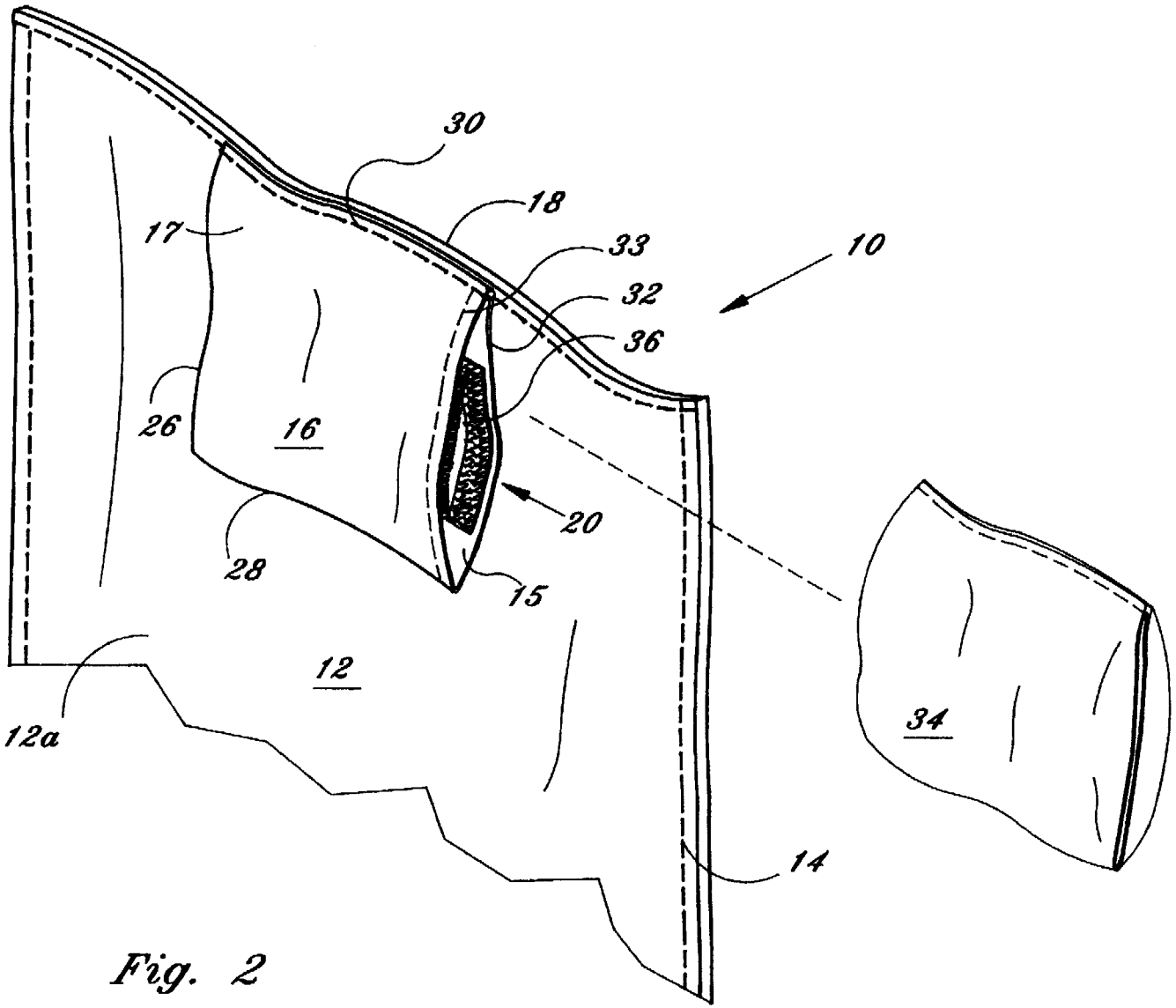
FIG. 2 shows a partial exploded perspective view of the present invention showing installation of a pillow into the pillow compartment.

Referring now to FIG. 2, pillow compartment 16 is open at end 32, and forms channel 20 for receiving pillow 34. Channel 20 is closed at end 32 by any suitable closure means, such as hook and loop fasteners 36, or snaps, zipper, buttons, and the like. The perimeter of open end 32 may be stitched at 33.

Figure 3:
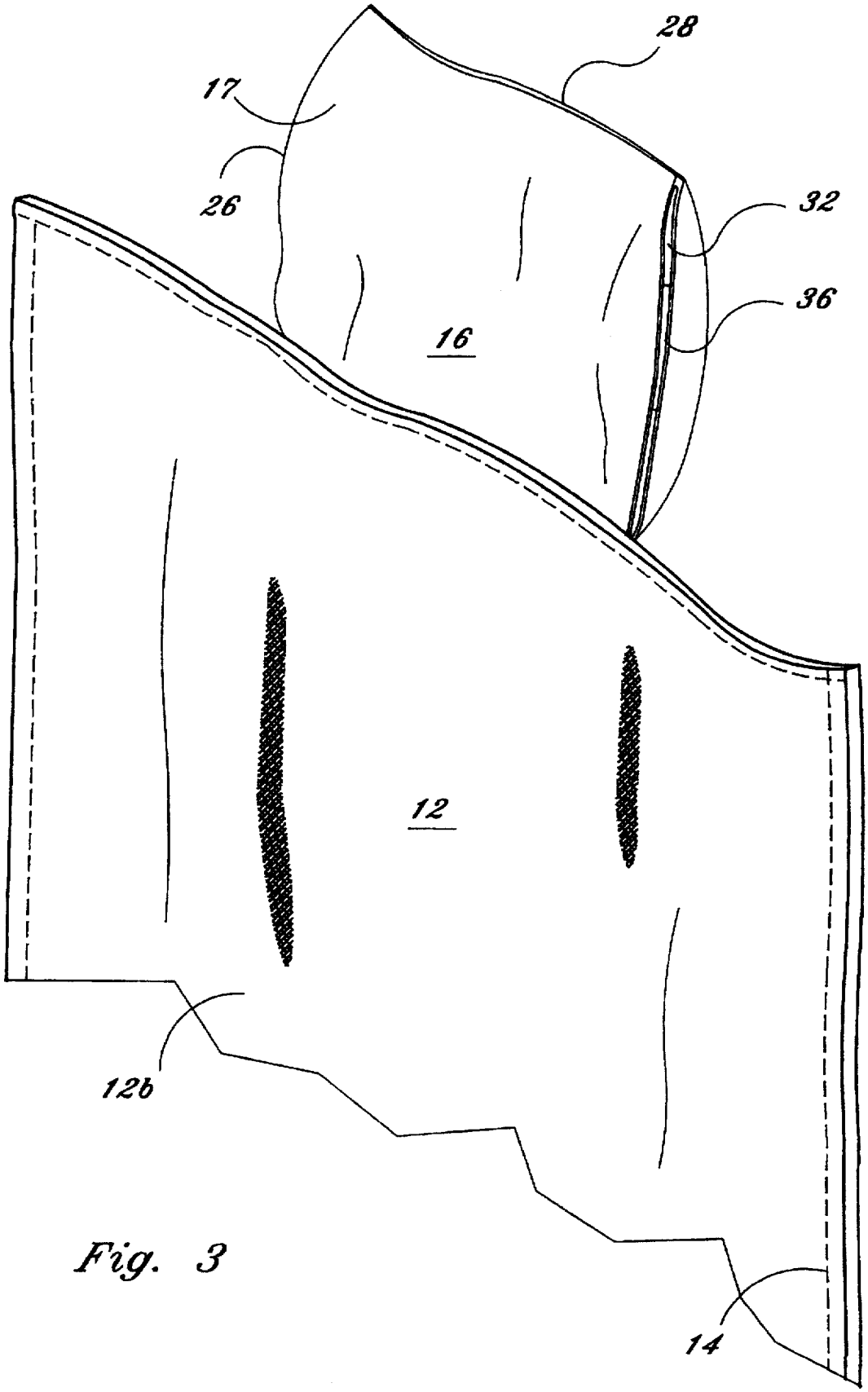
FIG. 3 shows a perspective view of the present invention with the pillow compartment in an alternate position raised above the towel portion.

In use, pillow compartment 16, with any suitable pillow 34, can be placed against towel surface **12*a* under towel 12, as shown in FIGS. 1 and 2, placed on towel surface 12*b* on top of towel 12 (not shown), or placed over towel 12, to position it for very tall people, or out of the way, as shown in FIG. 3. Pillow compartment 16, having closure 36, keeps pillow 34 clean by preventing sand, dirt, and debris from entering channel 20 and coming in contact wit pillow 24. The flexibility in placement of pillow compartment 16, and hence pillow 34, provides custom comfort for nearly any user, while keeping pillow 34 clean. When it is desired to clean towel 12, pillow 34 can easily and quickly be removed from channel 20 by opening closure 36. A fresh pillow 34 can thus also be quickly replaced into pillow compartment 16**.

Pillow compartment 16 can be selectively sized to accommodate a plurality of pillow sizes and construction materials. Pillow 34 can be made of any suitable pillow material including, but not limited to, plastic, foam, down, feather, air filled blabber, or fabric. The pillow compartment 16 prevents pillow 34 from becoming soiled. Therefore, pillow 34 can be received in pillow compartment 34 either with a separate and additional pillow case covering pillow 34 or without an additional pillow covering.

Although towel 12 as shown is preferably constructed from a cotton fiber-reactive dyed velour, towel materials capable of aesthetic patterns, and other conventional towel materials, can be utilized.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A beach towel and pillow case combination comprising:

a substantially rectangular moisture absorbent fabric sheet, said sheet sized substantially for use as a beach towel and having a length of approximately 60 inches and a width of approximately 30 inches, said sheet having one side with velour texture thereon;

a first and a second substantially rectangular moisture absorbent fabric panel each having a length approximately one-sixth the length of said fabric sheet and a width approximately one-half the width of said sheet, said first and second panels fastened together along three sides to form a pillow compartment fastened at one of said edges to an end of said fabric sheet to allow for selective positioning of said pillow compartment, said pillow compartment occupying approximately one-twelfth the surface area of said sheet, said pillow compartment including an opening sized to receive a pillow, said opening disposed substantially perpendicular to the end of said fabric sheet to which said pillow compartment is attached, said opening including means for closing to prevent dirt from reaching said pillow.

2. A beach towel and pillow case combination as in claim 1 further including a pillow received in said pillow compartment.

* * * * *